United States Patent [19]

Geiger

[11] 4,174,074

[45] Nov. 13, 1979

[54] BALL MILL

[75] Inventor: Armin Geiger, Wattwil, Switzerland

[73] Assignee: Gebrueder Buehler AG, Uzwil, Switzerland

[21] Appl. No.: 900,192

[22] Filed: Apr. 26, 1978

[30] Foreign Application Priority Data

Apr. 29, 1977 [CH] Switzerland ..... 5273/77

[51] Int. Cl.[2] ..... B02C 17/16

[52] U.S. Cl. ..... 241/46.11; 241/67

[58] Field of Search ..... 241/23, 46.11, 46.15, 241/65, 66, 67, 174, 191, 197

[56] References Cited

U.S. PATENT DOCUMENTS

| | | | |
|---|---|---|---|
| 2,060,408 | 11/1936 | Wood | 241/67 X |
| 3,993,254 | 11/1976 | Bicik et al. | 241/67 |
| 4,049,205 | 9/1977 | English | 241/67 |
| 4,121,776 | 10/1978 | Pujol | 241/46.11 |
| 4,129,261 | 12/1978 | Engels et al. | 241/46.11 |

*Primary Examiner*—Robert L. Spicer, Jr.
*Attorney, Agent, or Firm*—Merchant, Gould, Smith, Edell, Welter & Schmidt

[57] ABSTRACT

A heavy duty agitator ball mill for continuous grinding and dispersion of material suspended in a liquid has an upright rotor made of aligned rotor ring elements, mounted for rotation within a stator which preferably is also made up of aligned stator ring elements. Rotor and stator form a grinding chamber between them which holds a charge of grinding balls. Agitator members extend into the grinding chamber both from the rotor and from the stator. Both rotor and stator have cooling channels for flow of coolant, bounded in part by ribs formed on rotor and stator and hence promoting heat conduction. Working surfaces are of hard wearing materials as is made possible by the construction. The ring elements are readily replaceable, as are hard inserts of the agitator members.

30 Claims, 14 Drawing Figures

BALL MILL

FIELD OF THE INVENTION

This invention relates to a ball mill for continuous grinding and dispersion of material suspended in liquid. More particularly though not exclusively the invention relates to heavy duty agitator ball mills for the processing of viscous flowing masses in the foodstuffs industry, in the chemical industry and in paint manufacture, to finely grind solids material contained in those masses.

STATEMENT OF THE PRIOR ART

Agitator ball mills are known in which a rotor having outwardly radially extending agitator members is mounted for rotation within a stator having inwardly extending stator agitator members, to form a grinding chamber between the rotor and the stator holding a charge of usually spherical grinding elements of steel, glass, porcelain, ceramics or similar materials. Rotation of the rotor leads the agitator members to set the grinding elements into circulation, and at the same time grinding stock (i.e. material or product to be ground) is pumped into the grinding chamber where it is exposed to shearing and pressure stresses by the grinding elements resulting in an intensive comminution effect on the solids particles in suspension in the grinding masses. The heat resulting from friction is dissipated by cooling of the stator and the rotor.

At the outlet for the ground product from the grinding chamber separating devices are provided which allow the ground product to pass through but retain the grinding elements.

The size reduction forces obviously do not only act on the product to be ground but also subject the active parts of the mill, such as grinding elements, agitator members and walls, to strong wear. It has therefore already been proposed that the grinding elements should be made of high wear-resistant materials, such as tungsten carbide or similar hard metals, so that they have as long a working life as possible.

On the other hand, however, it must be accepted that the softer steels of which the stator, rotor and agitator members are generally made are subjected to increased wear and abrasion and continuous impact stress by the hard grinding elements present in the flowing medium.

For the desired grinding effect as regards degree of fineness, the dispersion and throughput aimed at, there are numerous parameters which apply, such as the selection of the size of mill, number and ball diameter of the charge of grinding elements, the rotation speed of the rotor, the shape and distance apart of the agitator members, the pressure and the time of dwell of the product to be ground in the grinding container.

In the mill constructions known hitherto there was a narrow limit set on the possibilities of improving the performance by any change in the above-mentioned relevant factors because of the wearing behaviour of walls, agitator members and grinding elements, so as not to risk an uneconomical operation as a result of the working life of the mill being too short.

In the case of agitator ball mills of the abovementioned type it is known, in order to achieve speed and pressure conditions which shall be as uniform as possible, to provide an annular grinding cross-section wherein the cylindrical agitator rotor has a diameter of at least one-third of the diameter of the stator. At the same time this also achieves a considerable increase in the cooling surface for the dissipation of heat via the cooled rotor. Reference may be had to German Auslegeschriften Nos. 1 214 516 and 1 233 237, German Offenlegungsschriften Nos. 2 443 799 and 2 633 225 and Swiss Pat. Nos. 459 724 and 400 734.

Agitator members which transmit the energy of motion of the rotor to the charge of grinding elements are generally finger-shaped, vane-shaped or tooth-shaped tools fitted on the rotor body in such a way that they can be easily replaced.

In order to improve the grinding and dispersing effect, the inner wall of the stator also carries similarly shaped tools which have the task of promoting movement of the charge of grinding elements relative to the agitator members.

It has now been found that when the relative movement in the grinding chamber increases, the size reduction effect is certainly enhanced, but also the wear of the agitator members and of the walls, as well as the heating of the product bring ground, increase enormously. In the result the process often becomes uneconomical and the maximum permissible temperature of the ground product is often exceeded.

The aim of the present invention is to provide an improved ball mill which by its construction, its components and especially the cooling means for dissipation of heat, and also by the advantageous selection of the materials for its active elements, such as stator, rotor and agitator members, is resistant to wear to an extent which has never before been achieved either as regards working life or as regards performance and economy.

BRIEF STATEMENT OF THE INVENTION

Accordingly the invention provides a ball mill for continuous grinding and dispersion of material suspended in a liquid, said mill comprising: a plurality of rotor ring elements, at least some of said rotor ring elements having rotor agitator members projecting outwardly therefrom, said rotor ring elements being aligned to constitute a rotor; a stator surrounding said rotor and having stator agitator members projecting inwardly therefrom; said rotor being mounted for rotation within said stator; said rotor and said stator forming a grinding chamber therebetween intended to hold a charge of grinding elements; stator cooling means for cooling said stator; rotor cooling means for cooling said rotor, said rotor cooling means comprising cooling ribs which at least in part form boundaries of rotor cooling channels and at least in part are bounded by a surface of said rotor ring elements; and said rotor ring elements being replaceable and being highly wear resistant on surfaces that are intended to come into contact with said grinding elements. Generally the rotor agitator members and the stator agitator members project radially.

In previous endeavours for achieving resistance to wear use was made mainly of structural steels for the rotor and stator. By their nature, however, such materials are of limited surface hardness, because according to known shaping technology they had to be capable of being machined by metal cutting and also had to be at least in some cases weldable, and had to withstand other forces than merely frictional and compression forces.

The modes of construction and shaping technology which can be adopted in mills embodying the invention can avoid these conditions regarding machinability and loading stresses and hence leads to far greater scope in the selection of materials. Furthermore, by use of the cooling ribs for increasing the surface areas for transmission of heat from the rotor to the coolant, it is possible to dissipate larger quantities of heat so that higher-grade materials can be stressed up to their permissible limits and the grinding output can be substantially increased. Moreover, the ring elements are replaceable so that even in the case of an overload of the rotor with consequent excessive wear the ball mill can be restored to readiness for operation by quite simple measures.

These features provided by the invention can be carried into practice in different ways, of which those regarded as the most important are listed below.

In a preferred embodiment the rotor ring elements which have rotor agitator members cast integrally with them arranged on a cylindrical rotor guide tube which bounds the rotor cooling channels on their inside. A central tensioning unit which also serves as a return pipe for coolant is under tensional stress and supplies the compressive force necessary for compressing the rotor ring elements. In another version the rotor ring elements are pressed together by tension bolts between two flanges fitted at the two ends of the rotor guide tube. The tension bolts are under high tensional force in order to take up the thermal expansions of the rotor rings with as little change as possible in the joint pressure. The end surfaces of the ring elements which adjoin one another are protected from the outlet of coolant by packings or packing compound. The surfaces can also be soldered or stuck together by adhesive.

The rotor cooling ribs provided for sub-dividing the annular space arranged between the rotor guide tube and the rotor ring elements through which the coolant flows can extend helically so that they form a continuous helical rotor cooling channel which is a favourable from the point of view of cooling. They can be cast together directly with the ring element or the guide tube or can be formed by welding a section rod of any desired cross-section on to the ring element or the guide tube, or by shaping by metal cutting.

The stator can be built up similarly from ring elements which are aligned in an outer guide tube and form with this and radial ribs a stator cooling channel running helically. Here again the ring elements advantageously hold shaped cast-on agitator members and can be held together by tensioning means.

The sub-division of the rotor and of the stator into ring elements can also be carried out by having a ring element carrying cast-on agitator members following a ring element devoid of agitator members. Accordingly, a smooth ring element of the stator can be arranged opposite a ring element of the rotor carrying agitator members and vice versa. When replacing the worn ring elements it is possible better in this way to take into account their different degree of wear.

A further advantage of this construction of the rotor resides in that it affords the possibility of spacing the rotor agitator members in different ways. Thus it is possible by simple rotary offset of the ring elements to arrange their agitator members for example so that they are staggered or so that they extend in alignment parallel to the rotor axis.

An agitator ball mill constructed in this way makes it possible to choose very hard materials for the production of the ring elements with agitator members which can only be shaped using the casting or grinding process.

The front edge of the agitator members seen in the direction of rotation is exposed to particularly high fatigue impact stresses as a result of the continuous impact and churning of the grinding elements. In known constructions such agitator members were designed as replaceable hardened steel pins screwed into the rotor and stator cylinders. Here again the choice of the hardness of the metal was limited by the machinability of the fixture and the stresses occurring.

A further subsidiary feature of the present invention therefore provides that the agitator members should be designed with supporting lugs cast on to the ring elements, on the front edges of which viewed in the direction of rotation there are fixed working elements, the material of which is harder than that of the supporting lugs.

The replaceable working element is advantageously placed on the supporting lug or fixed on to this in the form of a rod of hard metal of round or other cross-section.

In view of the known difficulty of shaping hard metals, the rod-shaped working elements are preferably brazed, adhered or riveted.

The supporting lug has the task of offering the hard metal working element a supporting surface which is suitable for pressure stresses and to release the hard brittle material to a large extent from bending stress.

Since tensional stresses are lacking, brazed and adhered joints are particularly suitable. As a result of this oxide-ceramic materials lend themselves for lining the supporting lug, such as aluminium oxide ($Al_2O_3$) or zirconium dioxide ($ZrO_2$) which have hardnesses of up to 2,300 in the Vickers scale. Finally, sintered mixtures, for example aluminium oxide with tungsten carbide, can be considered for the working elements to be adhered to the lugs.

At the base of the supporting lug as a further subsidiary development of the invention, the hard metal tool is inserted in a recessed bore. This avoids a known disadvantage of earlier constructions, in which the joints between agitator pins and cylindrical rotor surfaces are increasingly undermined by the action of the grinding elements.

As regards maximising cooling of the grinding operation, an attendant disadvantage is that highly wear-resistant materials, especially oxide ceramic materials, have a coefficient of thermal conductivity which is many times worse than that of steel.

This circumstance is countered in that the heat transfer surfaces of ring element to cooling medium on the rotor and stator are increased by the provision of radial ribs. The heat transfer surfaces between the working element and the supporting lug on the one hand and between the supporting lug and the ring element on the other have also been considerably enlarged as compared with the known contact surfaces of simple radial pins.

The advantages of a preferred form of the invention as described, compared with already known agitator ball mills, can be summarised as follows:

(a) The possibility of using highly wear-resistant hard material for wall elements, agitator members and working elements.

(b) Great strength of the working element fixture. The fixing means are exposed mainly only to pressure stresses.

(c) No danger of undermining the working element fixture on account of the recessing of the joint surfaces.
(d) Simple easy replacement of the ring elements.
(e) Good heat transfer from working element to supporting lug, from supporting lug to ring element and from ring element to the cooling surface.
(f) The possibility of the mechanical cleaning of the cooling surface after the ring elements have been dismantled.

BRIEF DESCRIPTION OF THE DRAWINGS

Several preferred embodiments of the invention will now be described by way of example with reference to the accompanying drawings in which.

DETAILED DESCRIPTION OF PREFERRED EMBODIMENTS

Figure 1:
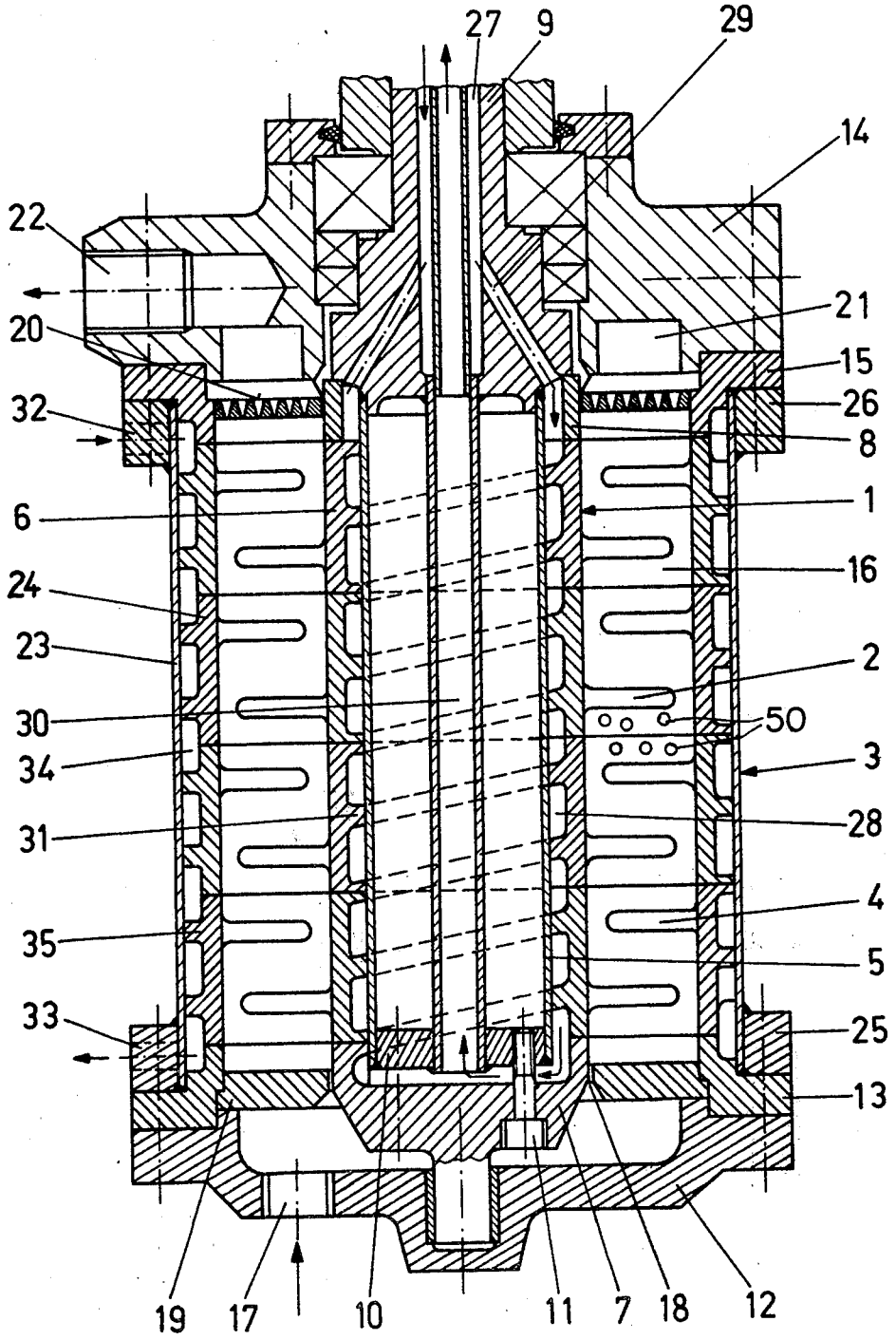
FIG. 1 shows in longitudinal section one form of agitator ball mill.

In the various figures corresponding parts have been designated by corresponding reference numerals.

The agitator ball mill according to FIG. 1 consists of a rotor 1 mounted for rotation about a vertical axis, with outwardly projecting rotor agitator members 2 and a stationary stator 3 surrounding the rotor 1 and having inwardly projecting stator agitator members 4. The rotor 1 has rotor ring elements 6 carrying the rotor agitator members 2. The ring elements 6 are aligned on a rotor guide tube 5, they are compressed between the rotor end piece 7 and the socket 8 and are pressed against the stub 9 of the drive shaft. The pressure force necessary for this purpose is supplied for example by the rotor guide tube 5 designed as a tensioning unit and firmly connected with the stub of the drive shaft 9 and whose end plate 10 is connected via a number of screws 11 with the rotor end piece 7. By tightening the screws 11 the rotor guide tube 5 is placed under tensional stress and the rotor ring elements 6 are compressed. The housing cover 12 is firmly connected with the stator 3 via the end ring 13 by means of screws shown in chain-dotted lines.

Between the rotor 1 and the stator 3 is a grinding chamber 16 with the charge of grinding elements 50. The lower cover 12 has an inlet aperture 17 for the grinding stock, i.e. the material of product to be ground. A separating gap 18, suitably formed between the rotor end piece 7 and a hole in a plate 19 firmly mounted between the lower cover 12 and the lower end ring 13, has the task of preventing the grinding balls from coming out of the grinding chamber 16, but allowing the grinding stock to pass through practically without hindrance.

At the top end of the grinding chamber 16 there is a separating device 20 through which the ground product, but no grinding balls, can pass into the separating chamber 21. The latter is connected with an outlet aperture 22 for the ground product provided in the upper bearing cover 14.

Figure 2:
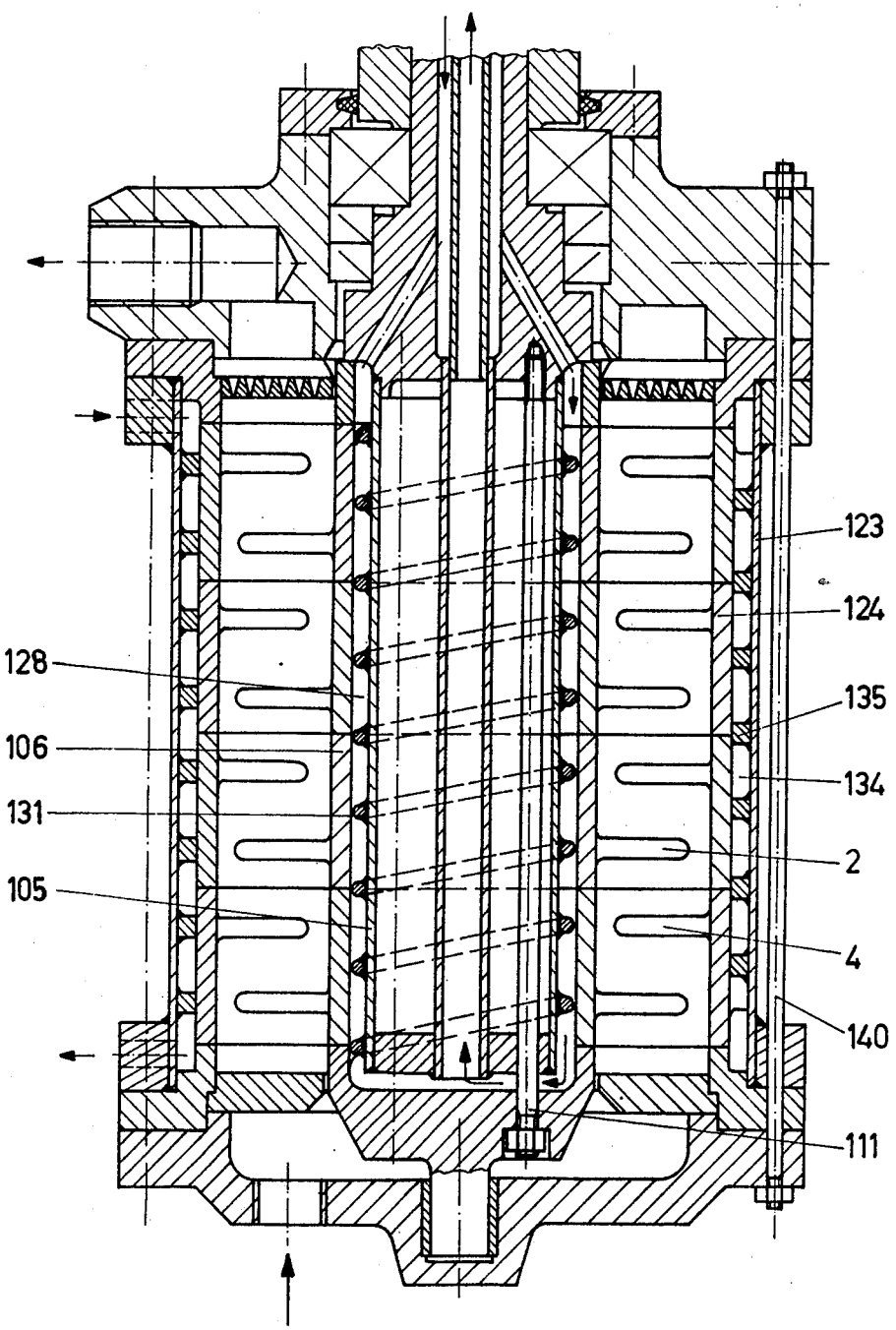
FIG. 2 shows likewise in longitudinal section a second form of mill.

The stator 3 has replaceable stator ring elements 24 carrying stator agitator members 4. These are aligned in the stator guide tube 23 which fast with its ends has flanges projecting radially outwards, namely a lower flange 25 and an upper flange 26. The stator ring elements 24 are held in position between the lower end ring 13 and the upper end ring 15, the lower flange 25 being connected by screws (indicated by chain dotted lines) with the lower end ring 13 and the lower cover 12 and the upper flange 26 being connected by screws (likewise indicated by chain dotted lines) with the upper end ring 15 and the upper bearing cover 14. Alternatively, the rotor and the stator ring elements could be compressed in known manner, as shown in FIG. 2, by a plurality of parallel tension bolts 111 or 140.

The rotor cooling device provided for cooling the rotor 1 has a feed channel 27, a rotor cooling channel 28, a plurality of connecting channels 29 joining these and a discharge channel 30 connected to the rotor cooling channel 28. The rotor cooling channel 28 extends helically around the rotor guide tube 5 and is bounded on one side by rotor cooling ribs 31 extending helically and projecting radially inwards and cast together with the rotor ring elements 6, and on the other side by the interior surfaces of the rotor ring elements 6. The discharge channel 30 extends centrally in the axial direction of the rotor 1 and passes through the drive shaft stub 9, whereas the feed channel 27 in the drive shaft stub 9 is formed as an annular channel surrounding the discharge channel 30.

The stator cooling device provided for cooling the stator 3 has a feed bore 32 provided in the upper flange 26, a discharge bore 33 provided in the lower flange 25 and a stator cooling channel 34 connected with these and extending helically around the stator ring elements 24. The cooling channel is bounded on one side by the stator cooling ribs 35 cast together with the stator ring elements 24 and extending helically and projecting radially outwards, and on the other side by the outer surfaces of the stator ring elements 24 and the inner surface of the stator guide tube 23.

The grinding stock to be processed is fed under pump pressure through the product inlet aperture 17 and the separating gap 18 into the grinding chamber 16, flows through this in a vertical direction to the separating device 20 and leaves the mill via the separating chamber 21 and the outlet aperture 22.

During the passage of the grinding stock its suspended solid particles are subjected in the activated charge of grinding elements to strong frictional and shearing stresses between the mill balls which are moving at high differential speeds. The grinding balls are activated by the rotor agitator members 2 rotating with the rotor 1 and the corresponding stator agitating members 4 on the stator 3.

The ring elements 6 and 24 surrounding the annular grinding chamber 16 are made of highly wear-resistant material. By means of the cooling ribs 31 and 35 the heat transfer surfaces between the coolant and the rotor 1 and the stator 3 are enlarged so that the rotor and stator cooling is sufficiently intensive despite the increased amount of heat occurring as a result of the high grinding output and the poorer thermal conductivity of the highly wear-resistant materials. The ring elements 6 and 24 can easily be fitted and just as easily dismantled. A seal can be provided between neighbouring ring elements by the use of sealing compound on their end surfaces or by brazing, to prevent the escape of coolant liquid into the grinding chamber 16.

Figure 9:
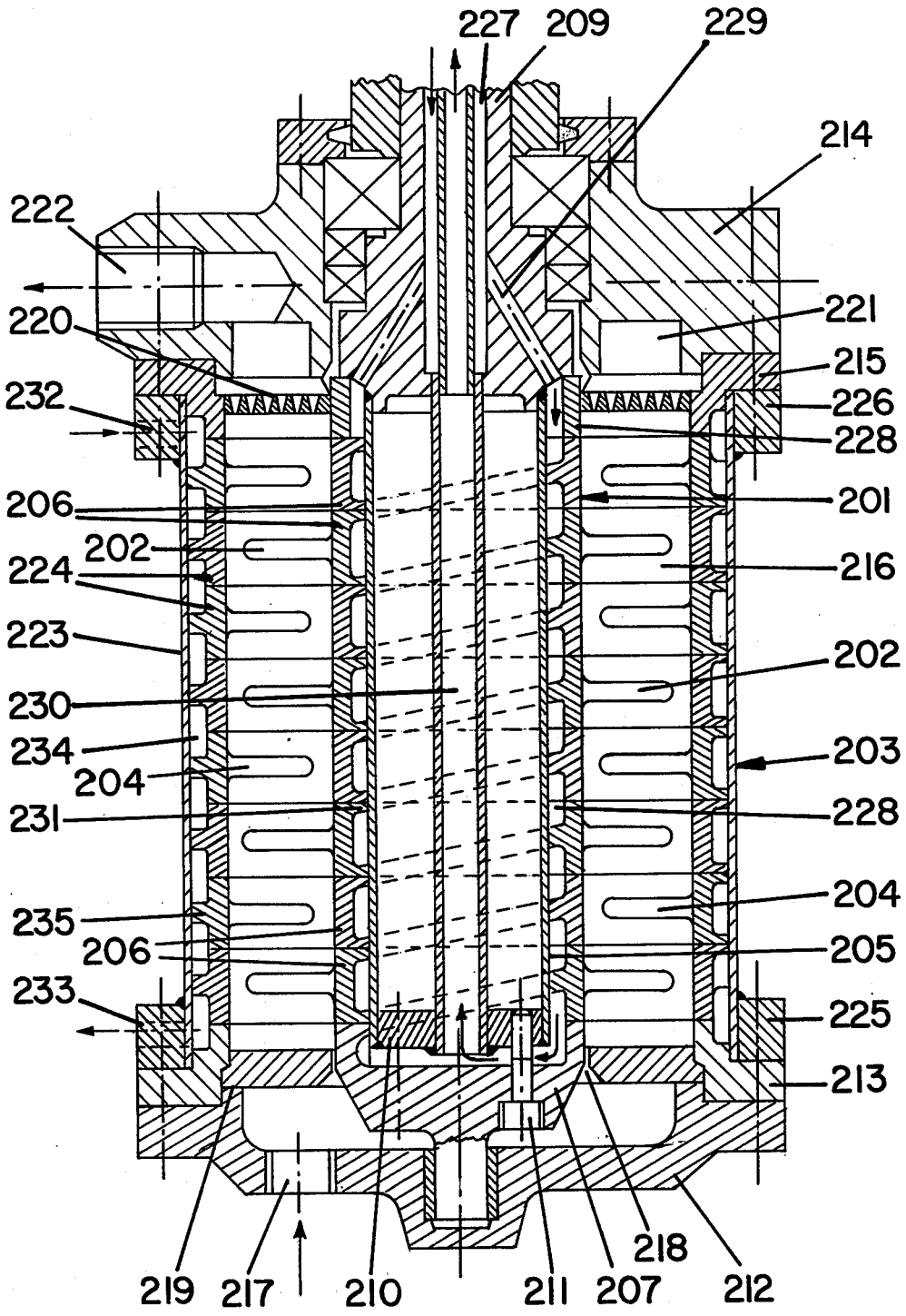
FIG. 9 shows in longitudinal section a third form of mill.

There is shown in FIG. 9 another manner of dividing a rotor 201 and a stator 203. Parts of the device shown in FIG. 9 which are similar to parts of the device shown in FIG. 1 will be indicated by like numerals in the 200 series. The ring elements 206, 224 of the rotor 201 and the stator 203 respectively are arranged so that a ring element 206, 224 which carries cast-on agitator members 202, 204 follows a ring element 206, 224 which is devoid of agitator members. Accordingly, a smooth ring element 224 of the stator 203 can be arranged opposite a ring element 206 of the rotor 201 carrying agitator members 202 and vice versa.

FIG. 2 shows a variant of the design of the ring elements 106 and 124 and shows the way they are mounted in the guide tubes 105 and 123. The rotor ring elements 106 have a smooth cylindrical internal surface and the helical rotor cooling ribs 131, e.g. of round cross-section, are set on the rotor guide tube 105, being brazed or welded to it, and form together with the adjoining surfaces of the rotor ring elements 106 the rotor cooling channel 128, which extends helically. In a similar manner the stator ring elements 124 have a smooth cylindrical outer surface and the helically designed stator cooling ribs 135, e.g. of rectangular cross-section, are inserted in the stator guide tube 123, being brazed or welded to it, and form together with the adjoining surfaces of the stator ring elements 124 the helical stator cooling channel 134.

Naturally it is also possible for the rotor cooling ribs 131 to be of rectangular cross-section and for the stator cooling ribs 135 to be of round or other desired cross-section, and they may if appropriate be formed integrally with the relevant guide tube. Furthermore, it is possible in both forms according to FIGS. 1 and 2 to provide several helical rotor and/or stator cooling channels extending in the manner of a multiple-thread screw.

Figure 3:
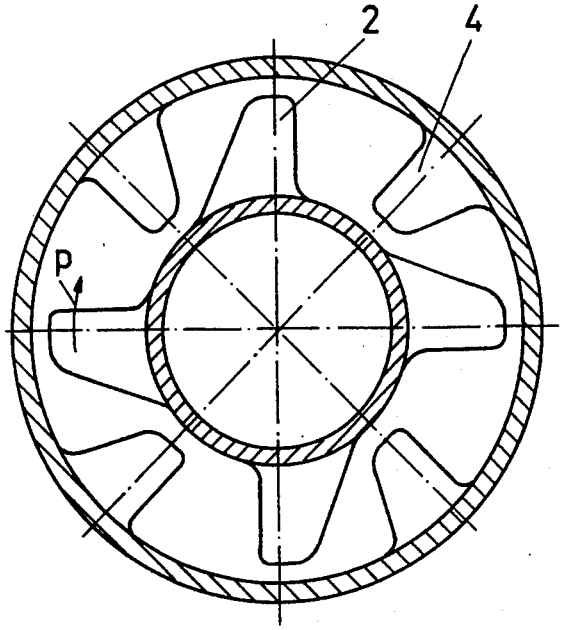
FIG. 3 is a cross-section through a rotor ring element and a stator ring element according to FIGS. 1 and 2 with integrally cast agitator members.
Figure 10:
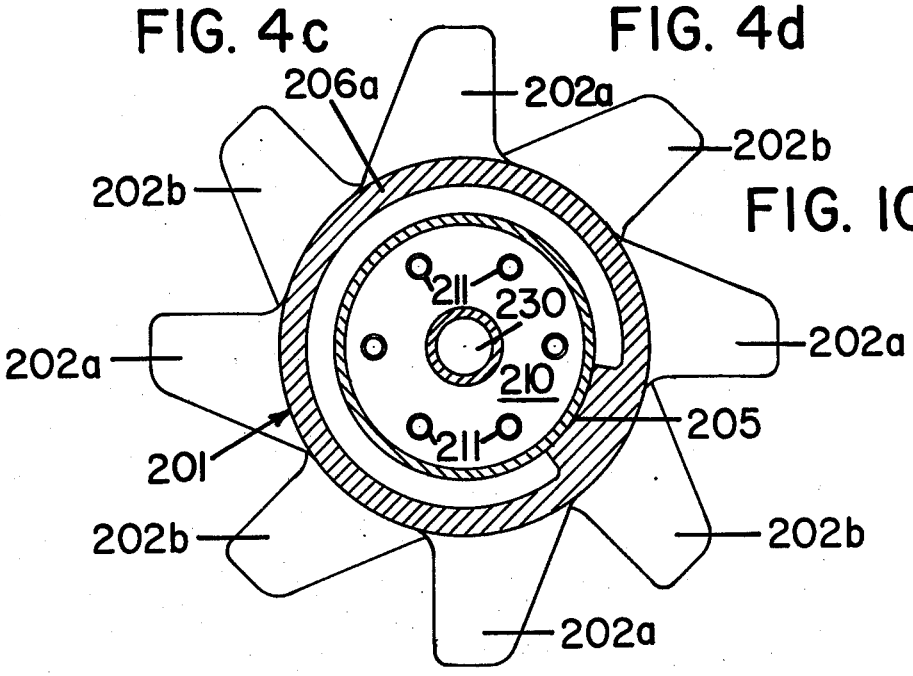
FIG. 10 is a transverse sectional view of the rotor illustrated in FIG. 9.

The cross-section of FIG. 3 shows the rotor agitator members 2 and the stator agitator members 4 according to FIGS. 1 and 2. Here the direction of rotation of the rotor is indicated by the arrow P. The agitator members 2 and 4 are cast integrally with their respective ring elements from highly wear-resistant materials, their cross-sections and moments of inertia increasing in the direction of the bottom in such a way that, firstly they are easy to produce having regard to casting technology, and secondly the bending stresses occurring during operation do not exceed maximum permissible values, and thirdly good heat conducting capacity is provided in the transition from the agitator member to the ring element. By sub-division of the rotor, as of the stator, into ring elements carrying agitator members, the possibility is provided, during installation to alter the arrangement of the agitator members to best advantage by simply turning round the ring elements. In this way, for example, instead of arranging the agitator members in an axis-parallel line as shown in FIGS. 1 and 2, they can be arranged alternately in two successive planes interrupted by gaps. See FIG. 10. FIG. 10 is a transverse sectional view of the rotor 201. Agitator members 202A are attached to a first ring element 206A and agitator members 202B are attached to an adjacent ring element, not seen in FIG. 10. By simple rotary offset of the ring element 206A and an adjacent ring element, the agitator members 202A and 202B are arranged in a staggered relationship as seen in FIG. 10.

Figure 4:
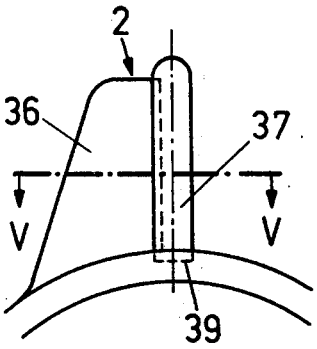
FIG. 4 illustrates a detail of a rotor agitator member with supporting lug and working element fixed thereto.
Figure 4A:
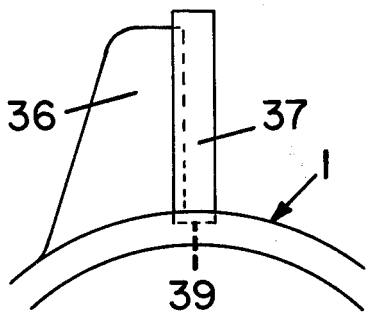
FIGS. 4*a–d* are similar to FIG. 4 and each illustrate a detail of a rotor agitator member with a supporting lug and working elements fixed thereto having different shaped ends.
Figure 4B:
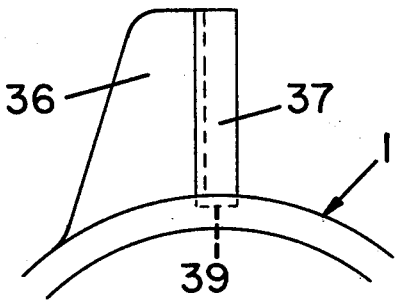
Figure 4C:
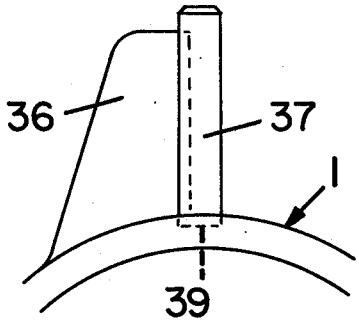
Figure 4D:
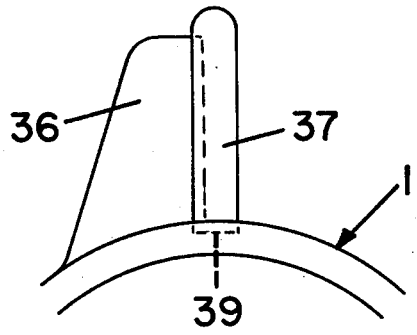

Now, since the leading edge of an agitator member viewed in the direction of rotation is subjected to particularly high wear, it is advantageous to make this edge as a replaceable working element of a still harder material. Such a rotor agitator member 2 is shown in FIG. 4 and consists of a supporting lug 36 and a replaceable working element 37, the latter extending in the radial direction of the rotor. The front edge of the supporting lug 36 has a concave recess 38 visible in FIGS. 5 and 6 to serve as a supporting or fixing surface for the working element 37, which possesses the shape of a straight rod of, for example, round cross-section with a rounded to flat point. FIGS. **4*a* and 4*b* each illustrate a working element 37 with a flat end. FIG. 4*c* illustrates a working element 37 with a beveled end and FIG. 4*d* illustrates a working element 37 with a rounded end. This working element 37, which naturally can also be provided for the stator agitator members 4**, is made of materials that are particularly hard, to the point of brittleness such as tungsten carbide or molybdenum carbide hard metals, or oxide ceramic and sintered metal materials, which do not lend themselves to machining and are suitable to withstand stress only in compression.

Figure 5:
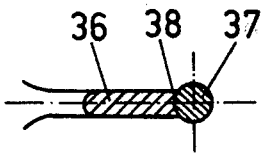
FIG. 5 is a section of the rotor agitator member of FIG. 4 taken along the line V—V.

The method of fixing assumed in FIGS. 4 and 5 by brazing or adhesion into the recess 38 of the supporting lug 16 ideally meets these conditions. In the rotor ring element a recessed hole 39 is provided for holding the working element 37, so that erosion by the grinding elements and by ground product on its supporting base will not undermine its anchorage.

Figure 6:
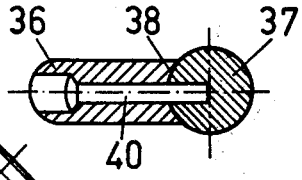
FIG. 6 is a section of the rotor agitator member of FIG. 4, on a larger scale, the working element being riveted to the supporting lug.

Instead of brazing or adhesive it is possible for the working element 37 to be fixed to the supporting lug 36 by means of one or more rivets. In FIG. 6 such a releasable connection is shown, in which the rivet 40 brazed into the working element 37 passes through a hole in the supporting lug 36 and is riveted to the other end of the latter. Accordingly the working element 37 is already provided during its production in the sintering process with the blind hole for taking the rivet 40, and this is brazed into the blind hole.

The combination of working-element-with-rivet corresponds to the condition of supply as a spare part for re-fitting a mill. For the user of the mill it is therefore very simple, by drilling out the head of the rivet to remove the old worn working element, to introduce the new working element with its rivet and then to peen the heads of the rivets in the blind holes of the supporting lugs.

Figure 7:
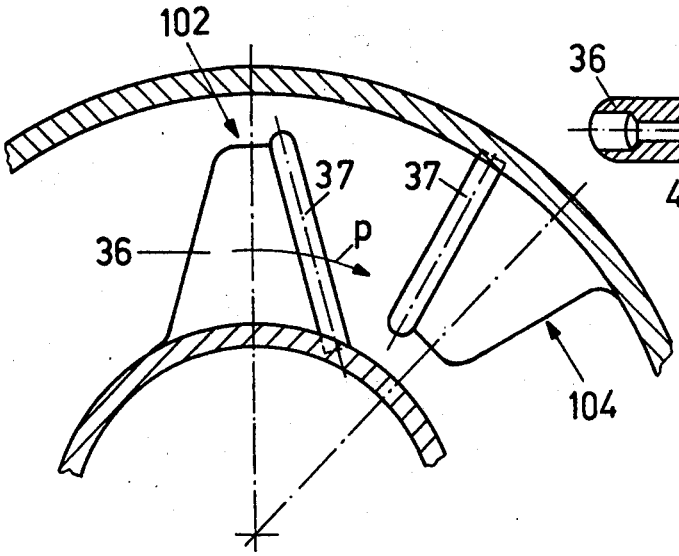
FIG. 7 shows in cross-section part of a rotor and a stator ring element according to FIGS. 1 and 2 with symmetrical agitator members.

The cross-section according to FIG. 7 shows how it is also possible for symmetrically constructed agitator members to be provided with replaceable working elements. The working elements 37 are then no longer placed radially, but at an acute angle to the radial position. This is necessary if the agitator unit during its movement is intended to impart to the grinding stock and the grinding elements not only tangential but also a radial movement component, which can be advantageous for certain purposes.

Figure 8:
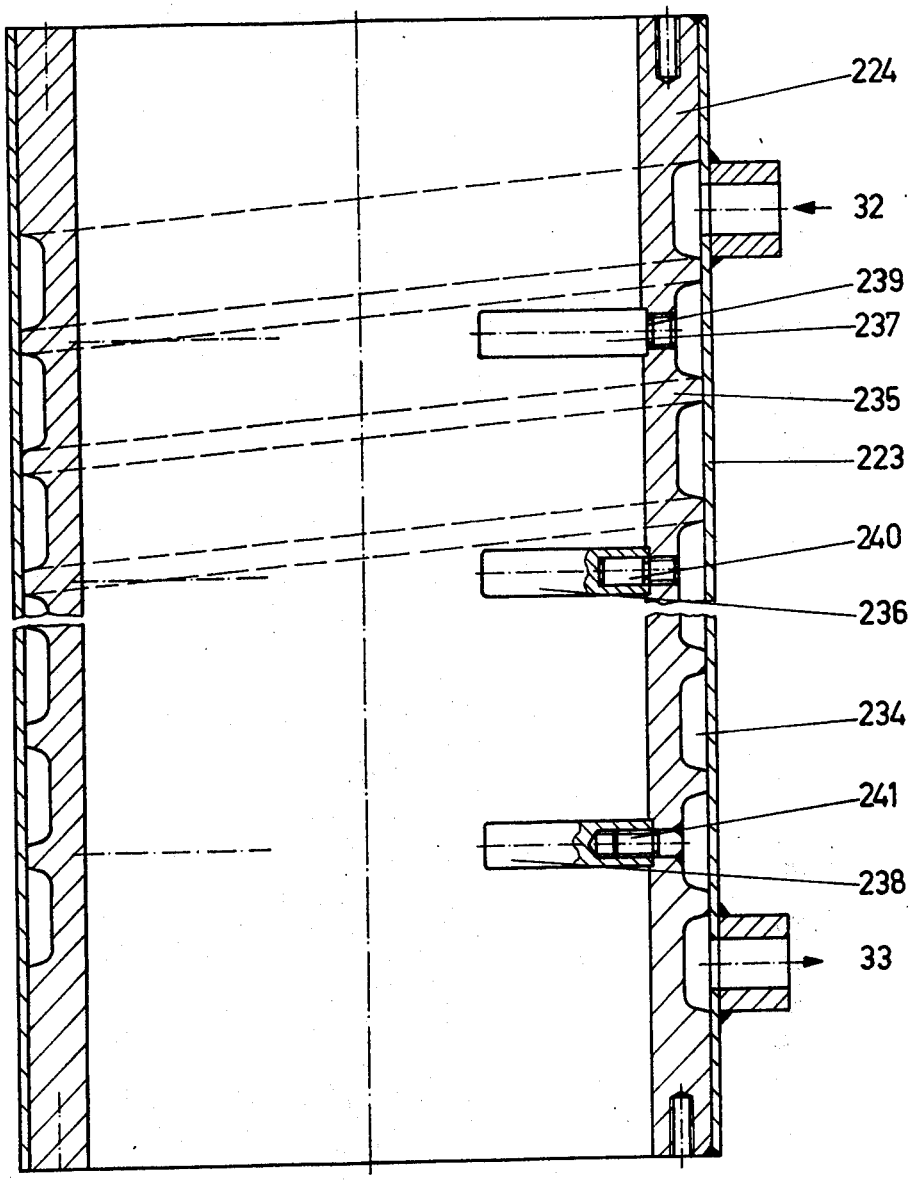
FIG. 8 shows in longitudinal section a stator of a third form of mill and illustrates several ways of fixing the agitator rods.

In FIG. 8 there is shown a further variant of the stator which comprises a ring element 224 consisting of a body strong enough to provide anchorages, which is produced for example of stainless wear-resistant material by the sand casting process, possesses on its outer surface cast-in helical stator cooling ribs 235 and is surrounded by an outer cooling jacket 223. The ring element 224 surrounds with its cooling jacket 223 one or more helical stator cooling channels 234 which communicate with the inlet aperture 32 and the outlet aperture 33. The cooling jacket 223 is firmly brazed at both ends to the ring element 224 so as to prevent the coolant from running out.

The ring element 224 is equipped with a number of cylindrical agitator rods 236, 237, 238, projecting inwards in a radial direction, three of which are shown with different anchorages, and which can be arranged between the rotor agitator members (not shown) in various planes at right-angles to the axis of the stator. They can be made of machinable and hardenable highly wear-resistant types of steel. For holding the agitator rods recessed bores are provided in the form of counterbores 239 in the stator ring element 224 in order to prevent any undermining by the erosion effect of grinding elements and ground product at the base surfaces of the agitator rods. The agitator rod 237 is shown screwed into the stator cylinder 224 for example with an external thread. The agitator rod 236 is shown with a different anchorage namely a brazed-in threaded pin 240, which in turn is screwed into the stator cylinder. Finally the connection shown for the agitator rod 238 is also releasable in that the threaded pin 241 is welded into the stator cylinder and the agitator rod 238 has an internally threaded bore to receive the pin 241.

If desired the ring element 224 can have a smooth outer surface and the cooling ribs 235 of round or rectangular cross-section can be brazed or welded to the cooling jacket 223 or to the ring element 224, as has already been shown in relation to FIG. 2. Furthermore, instead of the agitator rods 236, 237, 238 it is possible to provide agitator members cast integrally with the ring elements such as those according to FIG. 3 or agitator members with supporting lugs and working elements like those according to FIGS. 4 to 7, as regards their construction and materials.

I claim:

1. Agitator mill for continuous grinding and dispersion of material suspended in a liquid, said mill comprising: a plurality of rotor ring elements, at least some of said rotor ring elements having rotor agitator members projecting outwardly therefrom, said rotor ring elements being aligned to constitute a rotor; a stator surrounding said rotor and having stator agitator members projecting inwardly therefrom; said rotor being mounted for rotation within said stator; said rotor and said stator forming a grinding chamber therebetween intended to hold a charge of grinding elements; stator cooling means for cooling said stator; rotor cooling means for cooling said rotor, said rotor cooling means comprising cooling ribs which at least in part form boundaries of rotor cooling channels and at least in part are bounded by a surface of said rotor ring elements; and said rotor ring elements being replaceable and being highly wear resistant on surfaces that are intended to come into contact with said grinding elements.

2. Mill as claimed in claim 1 further comprising a cylindrical rotor guide tube, said rotor ring elements being aligned on said rotor guide tube and said rotor guide tube forming inner boundaries of said rotor cooling channels.

3. Mill as claimed in claim 2 wherein said rotor guide tube is formed as a tension unit and under tensional stress compresses said rotor ring elements.

4. Mill as claimed in claim 1, said stator comprising a plurality of stator ring elements at least some of said stator ring elements having stator agitator members projecting inwardly therefrom, said stator ring elements being aligned to constitute said stator; and said stator ring elements being replaceable.

5. Mill as claimed in claim 2 or claim 4 wherein at least some of said ring elements are arranged such that each ring element having agitator members adjoins a said ring element devoid of said agitator members.

6. Mill as claimed in claim 2 or claim 4 wherein said agitator members of at least one said ring element are staggered with respect to those of an adjoining ring element.

7. Mill as claimed in claim 4 further comprising a cylindrical stator guide tube, said stator ring elements being aligned within said stator guide tube and said stator guide tube forming outer boundaries of said stator cooling channels.

8. Mill as claimed in claim 1 wherein said stator comprises a stator ring element cast with said stator agitator members in one piece.

9. Mill as claimed in claim 8 further comprising a sheet casing tube surrounding said stator ring element, said sheet casing tube forming an outer boundary for said stator cooling channels.

10. Mill as claimed in claim 4 or claim 7 wherein said stator ring elements are highly wear resistant on surfaces that are intended to come into contact with said grinding elements.

11. Mill as claimed in claim 1 wherein said rotor ring elements and said rotor agitator members consist of cast material that is highly wear resistant.

12. Mill as claimed in claim 4 wherein said stator ring elements and said stator agitating members consist of cast material that is highly wear resistant.

13. Mill as claimed in claim 11 or claim 12 wherein said agitator members comprise wear parts consisting of brittle hard material, said wear parts being parts liable in operation to be subjected to heavy wear but only to slight mechanical stress.

14. Mill as claimed in claim 1 wherein at least some of said agitator members are comprised of supporting lugs and working elements, said working elements being supported by said lugs on a front edge thereof as seen in the direction of rotation of said rotor, and the material of said working elements being harder than that of said lugs.

15. Mill as claimed in claim 14 wherein said working elements extend in a direction that is inclined with respect to a radius from the axis of rotation of said rotor.

16. Mill as claimed in claim 14 wherein said working elements are constituted by round rods.

17. Mill as claimed in claim 16 wherein said round rods have ends whose shape is selected from a group which comprises rounded shapes, flat shapes and bevelled shapes.

18. Mill as claimed in claim 16 wherein said round rods are made of hard metal, said metal being of a hardness which exceeds the value $HV_{30}=1750$ in the Vickers hardness scale.

19. Mill as claimed in claim 14 wherein said working elements are made of a material selected from a group which comprises the oxide-ceramic materials and the sintered metallic carbide mixed materials.

20. Mill as claimed in claim 14 wherein said working elements are supported on said lugs by a joint selected from a group which comprises brazed joints, adhered joints and mechanical joints.

21. Mill as claimed in claim 20 wherein said lugs have a recess and said working elements are supported in said recesses.

22. Mill as claimed in claim 14 wherein at least one said ring element has a recessed bore and at least one said working element is let into a said recessed bore, whereby erosion of said ring element will not readily undermine said working element.

23. Mill as claimed in claim 8 wherein said stator agitator members consist of cylindrical agitator rods, said agitator rods projecting inwardly so as to engage between said rotor agitator members, said agitator rods being secured by screw connections to a wall of said stator ring element, said screw connections comprising a bore recessed in said wall, whereby erosion of said stator ring element will not readily undermind said agitator rods.

24. Mill as claimed in claim 23 wherein said screw connections comprise cylindrical screw threaded pins, said pins being brazed to said agitator rods and said pins being screwed into said wall.

25. Mill as claimed in claim 23 wherein said screw connections comprise screw threaded pins projecting inwardly from said wall, and internally threaded bores in said agitator rods, said agitator rods being screwed onto said threaded pins.

26. Mill as claimed in claim 2 or claim 7 or claim 9 wherein at least one of said cooling means comprises at least one helical cooling channel for flow of liquid coolant therethrough, said helical channel being bounded by cooling ribs and by at least one wall of said ring elements and by at least one of said tubes.

27. Mill as claimed in claim 26 wherein at least some of said cooling ribs are formed as integral castings with said ring elements.

28. Mill as claimed in claim 26 wherein said cooling ribs are secured to said ring elements by means selected from a group which comprises brazing and adhesion.

29. Mill as claimed in claim 26 wherein at least some of said cooling ribs are formed as integral castings with at least one of said tubes.

30. Mill as claimed in claim 26 wherein at least some of said cooling ribs are secured to at least one of said tubes by means selected from a group which comprises brazing and welding.

* * * * *